United States Patent [19]

Hildebrandt

[11] Patent Number: 4,699,535

[45] Date of Patent: Oct. 13, 1987

[54] WRITING IMPLEMENT FOR CALLIGRAPHY AND METHOD OF USING SAME

[76] Inventor: William J. Hildebrandt, 25 Beaverbrook Rd., West Simsbury, Conn. 06092

[21] Appl. No.: 859,807

[22] Filed: May 5, 1986

[51] Int. Cl.[4] ..... B43K 17/00

[52] U.S. Cl. ..... 401/35; 401/235; 33/41.4

[58] Field of Search ..... 401/34, 35, 19, 20, 401/88, 256, 257, 235; 33/41.1, 41.4, 41.2, 44; 15/257.073

[56] References Cited

U.S. PATENT DOCUMENTS

| | | | |
|---|---|---|---|
| 310,168 | 1/1985 | Arnold | 33/41.4 |
| 337,712 | 3/1886 | Smitten . | |
| 428,250 | 5/1890 | Hazen et al. | 401/35 |
| 946,036 | 1/1910 | Hallock | 401/35 |
| 989,481 | 4/1911 | Boesser . | |
| 1,407,738 | 2/1922 | Erickson | 33/41.4 |
| 4,171,168 | 10/1979 | Braun | 401/35 |

FOREIGN PATENT DOCUMENTS

| | | |
|---|---|---|
| 30336 | 3/1904 | Switzerland . |
| 3118 | of 1808 | United Kingdom . |

*Primary Examiner*—Cornelius J. Husar
*Assistant Examiner*—Joseph A. Fischetti

[57] ABSTRACT

A writing implement for generating a pair of lines which will vary in spacing depending upon the down pressure applied includes a handle, a pair of elongated blades of flexible material which are secured at one end to the handle and which project therebeyond. The blades have their minor axes intersecting at an angle of approximately 45° to 135°, and marking elements are secured to the free ends of the blades and project therefrom with the points thereof being closely spaced in the unflexed condition of the blades. When the user applies downward pressure to the writing implement, the blades flex along their longitudinal axes, and this moves the points of the marking elements apart to generate a pair of spaced lines. Various types of marking elements may be replaceably seated in barrel portions at the free ends of the blades.

15 Claims, 12 Drawing Figures

10

WRITING IMPLEMENT FOR CALLIGRAPHY AND METHOD OF USING SAME

BACKGROUND OF THE INVENTION

The present invention relates to writing implements and, more particularly, to writing implements for producing and demonstrating calligraphy and other specialized forms of writing involving varying widths of written strokes in larger sizes than possible with the normal pointed pen.

The flexible pointed pen styles of writing, including those known as Lettre Italienne, Coulee, German Chancery Hand, English Round Hand, Copperplate and Spencerian, developed after the year Circa. 1550 from the Papal Chancery hands, e.g., Cancellaresca or Italic, under the influence of the pointed quill pen and the art of copperplate (intaglio) engraving as exploited in the then still young art of letterpress printing. The advent of the pointed steel pen in the 1820's accelerated the spread of these styles into commercial as well as artistic writing. These styles all depend generally on creating the thick and thin parts of the pen stroke, which give solidity and "color" to the letter forms, by varying the pressure on the pen point. A light pressure gives a line whose thickness depends on the pressure applied.

Today, with the continued interest of students and practitioners of artistic writing in the script styles of the past, improved means for teaching and demonstrating the flexible pointed pen styles are needed. The ordinary pointed steel pen of today is still used with varying hand pressure to achieve the graceful thick/thin strokes demanded by these scripts. However, steel pens can only provide stroke thicknesses up to about 1 to 2 mm. in width without fracture or permanent set, and this limits the height of small letters (i.e., a, m, n, x, etc.) to about 10 mm. to 15 mm. Thus, when demonstrating to a group of students how to write these scripts, the letters cannot be made large enough for an entire class of students to observe the letter structure and the dynamics of writing the letters. Conventional methods of demonstrating these scripts using thick pieces of chalk twisted during the writing stroke to vary the stroke thickness, can illustrate the letter shape but cannot demostrate the structure and the pen point dynamics of the actual steel pen.

It is an object of the present invention to provide a novel writing implement for producing a pair of line markings which are variably spaced in accordance with downward pressure applied to the point of the implement.

It is also an object to provide such a writing implement which may be used for demonstrating styles of writing involving the variation in thickness of the generated line(s).

Another object is to provide such a writing implement which may be readily fabricated and which is simple to use and rugged in construction.

Still another object is to provide a writing method for generating a pair of lines which may be readily varied in spacing to demonstrate calligraphic and other writing techniques.

Another object is to provide a writing instrument for use in rapidly laying out and designing pointed pen type lettering of large size for commercial art work, signs, trademarks, etc.

SUMMARY OF THE INVENTION

It has now been found that the foregoing and related objects and advantages may be readily attained in a writing implement for generating a pair of lines of variable spacing by varying the downward pressure on the marking point of the implement. The implement includes a handle for gripping by the writer's hand and a pair of elongated blades of flexible material having one end secured to the handle adjacent its one end and projecting beyond that end of the handle. The blades have their major axes extending along the length thereof and parallel to the axis of the handle and their minor axes extending perpendicularly to the major axes. The blades are oriented on the handle so that the minor axes intersect to define an included angle of about 45°–135°. Secured to and projecting from the other or free ends of the blades are a pair of marking elements, and the marking points at the projecting end thereof are closely spaced. Sufficient downward pressure applied by the writer's hand against the points and thereby the blades against a work surface causes the blades to flex along their major axes and the points of the marking elements to move apart to generate a pair of spaced lines with the spacing varying with the amount of pressure applied.

The marking elements may be pen points which retain ink along the length thereof for dispensing at the points thereof, or pencil leads to generate the lines.

Desirably, the blades are metallic and taper along the minor axes to a reduced width adjacent the other ends thereof. The blades are preferably of generally planar cross-section over substantially the entire projecting portion thereof, and have increasing flexibility towards the other ends thereof. The blades desirably have substantially rectilinear abutting edges along one elongated edge thereof, and the opposite edges converge over at least some of the length of the projecting portions.

To facilitate use of the implement and choking of the flexure when forming small letter forms, the handle desirably tapers to a reduced thickness at its end adjacent the marking elements. Thus, the handle provides a surface against which the flexible blades may be pressed by the user to restrain their flexing.

In the method of writing using the writing implement, the writing implement is held at an acute angle to the surface of a workpiece to be inscribed and moved along the surface to generate a pair of lines thereon. Varying down pressure is applied to the implement and thereby the points to produce flexing of the blades to vary the spacing between the points and produce lines on the surface of varying spacing.

BRIEF DESCRIPTION OF THE ATTACHED DRAWINGS

Figure 3:
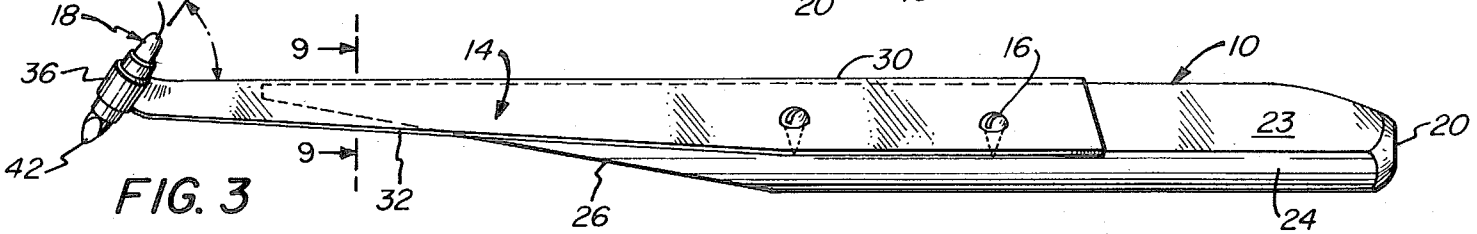
FIG. 3 is a side elevational view thereof.
Figure 6:
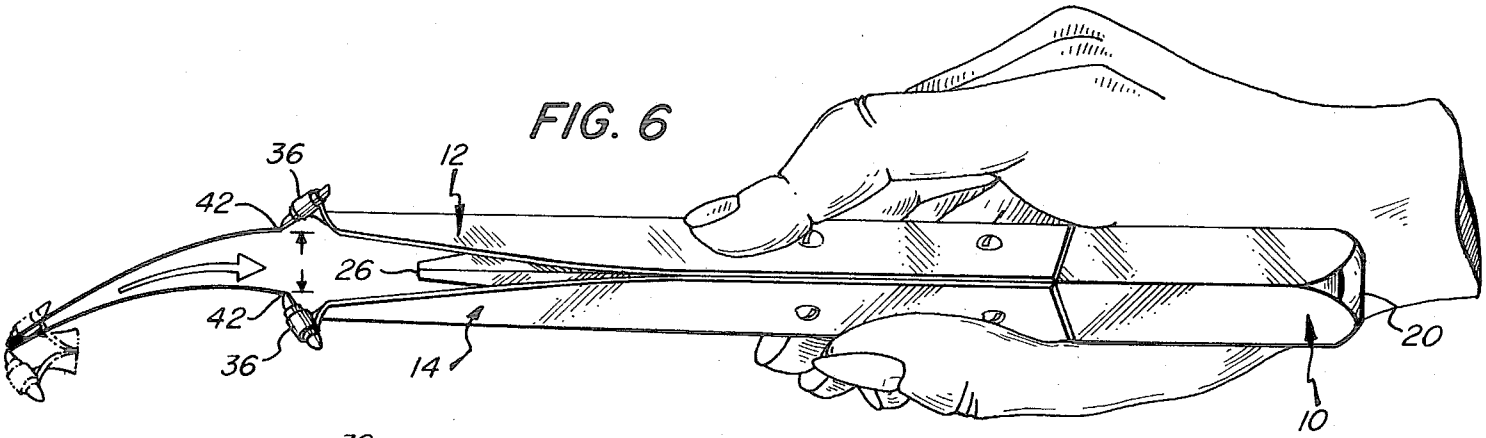
Figure 7:
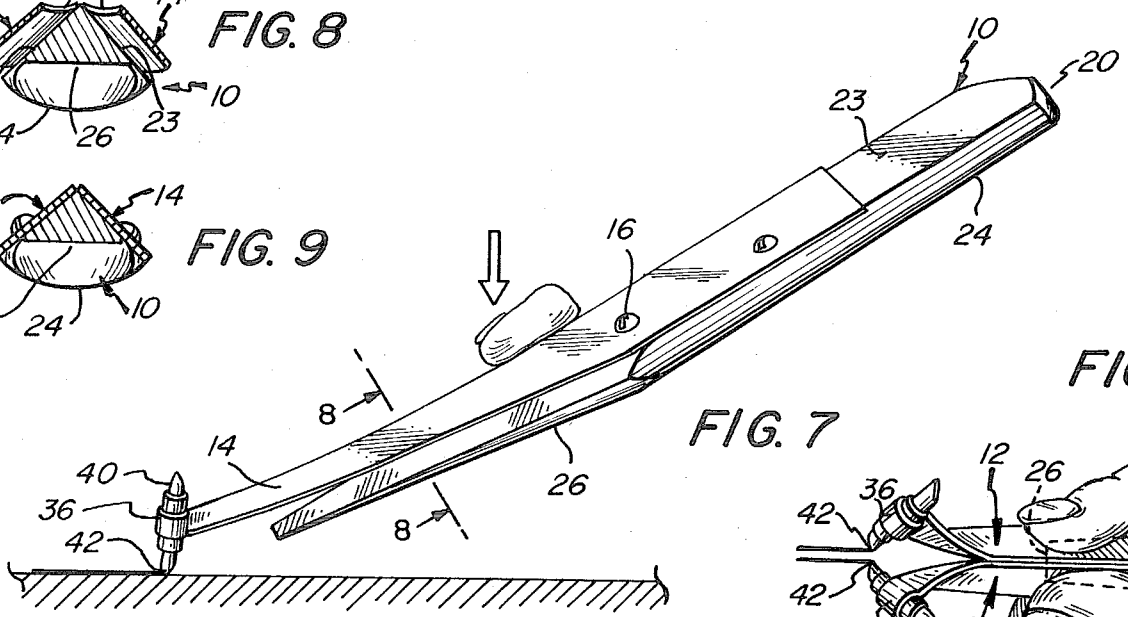
Figure 12:
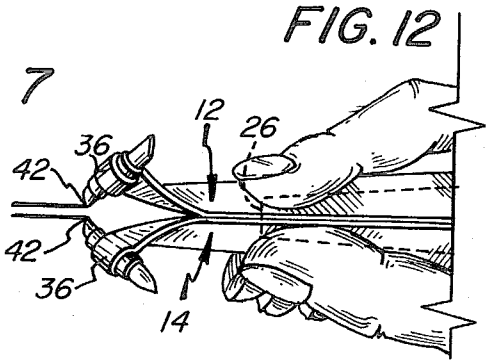
Figure 8:
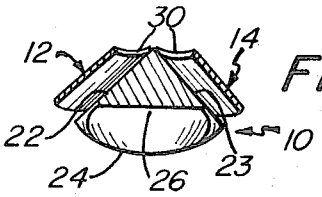
Figure 9:
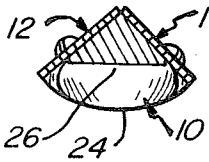
Figure 10:
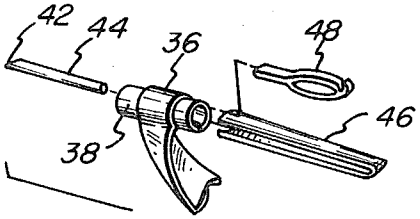
Figure 11:
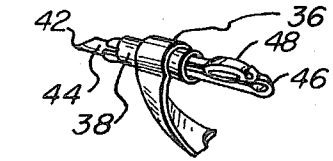

FIG. 6 is a partially diagrammatic view of the writing implement as being used by a user whose hand is illustrated and showing in phantom line at the far left side of the illustration the end of the implement prior to application of substantial pressure upon the blades and in solid line the points and blades as spread apart by the application of pressure by the user, and further the diverging lines as a result the effect of increasing pressure as the implement is moved in the direction of the arrow;

FIG. 7 is a diagrammatic view showing the implement in side elevational view with the blades flexing as a result of pressure applied by the user whose finger is fragmentarily illustrated with the vertical component of the pressure indicated by the vertically extending arrow;

FIG. 8 is a sectional view along the line 8—8 of FIG. 7;

FIG. 9 is a sectional view along the line 9—9 of FIG. 3;

FIG. 10 a fragmentary exploded view of the end of a blade with a pencil lead marking implement supported thereon;

FIG. 11 is an enlarged view of the assembled marking implement and fragmentary end of the blade shown in FIG. 10; and FIG. 12 is a view similar to FIG. 6 showing the user's hand choking the flexture of the blades.

DETAILED DESCRIPTION OF THE ILLUSTRATED EMBODIMENTS

Turning first in detail to FIGS. 1-5 of the attached drawings, a writing implement embodying the present invention is comprised of an elongated handle generally designated by the numeral 10, a pair of flexible blades generally designated by the numerals 12,14 attached at one end to the handle 10, marking elements generally designated by the numeral 18 and supported at the free ends of the blades 12,14.

The handle 10 is elongated and has a pair of flat surfaces 22,23 intersecting to define a desired included angle therebetween for supporting the blades 12,14 in a desired angular relationship. In this particular embodiment, the remainder of the cross-section of the handle 10 is provided by a convexly arcuate surface 24 extending over a substantial distance from the remote end 20, and a planar surface 26 which tapers upwardly as seen in FIG. 3 to reduce the thickness of the handle 10 in the direction of the marking elements 18. The handle 10 may be fabricated from any material providing the desired durability and resistance to writing fluids and solvents that may be used in connection therewith, suitable materials including wood, metal and chemically resistant synthetic resins.

The blades 12,14 are formed from strips of sheet material and are secured to the handle 10 by the screws 16. As indicated, the blades 12,14 are elongated with a principal axis extending in the direction of elongate length and a minor axis extending transversely thereof. The minor axis is substantially smaller than the principal axis, and the blades have abutting rectilinear edges 30 and opposite edges 32 which taper over a substantial portion of the free length thereof towards the marking elements 18. As a result the flexibility of the blades 12,14 increases towards the marking elements 18. In the illustrated embodiment, the free ends of the blades 12,14 are bent and rolled to provide holding barrel portions 36 which support the marking elements 18 so that the operative points 42 thereof are closely spaced in the unflexed condition of the blades 12,14. The barrel portion 36 supports a sleeve 38 which seats the writing implement 18.

In the embodiment of FIGS. 1-7, the writing implement 18 comprises a pultruded member having small channels extending axially therealong which will retain ink by capillary action, and one end is sharpened to provide the writing point 42. The pultruded member 40 is friction fit into the sleeve 38. As a result, when the points 42 of the writing elements 18 are placed against a ink receiving surface (not shown), ink will flow from the reservoirs of the pultruded elements 40 and off the tips or points 42 onto the surface.

In the embodiment of FIGS. 10 and 11, the marking element 18 utilizes a pencil lead 44 which is received in the split holder 46 which provides a rectangular recess therein. To clamp the lead 44 in the holder 46, and to releasably clamp that subassembly in the sleeve 38, a tensioning shim 48 is inserted into the sleeve 38 and bears upon the surface of the sleeve 38 end holder 46.

Figure 1:
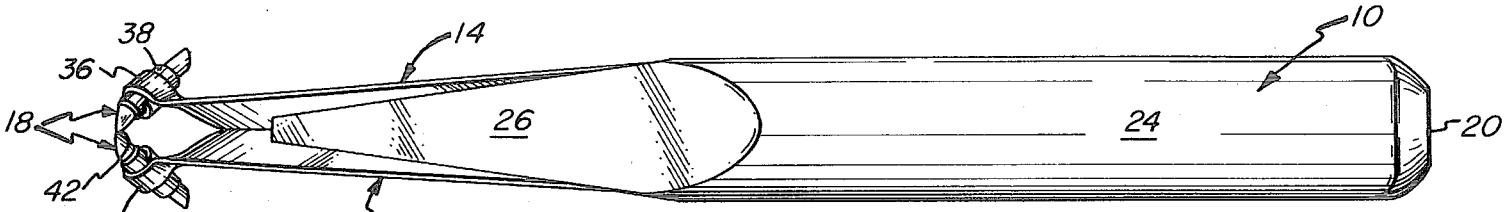
FIG. 1 is a bottom view of a writing implement embodying the present invention.
Figure 2:
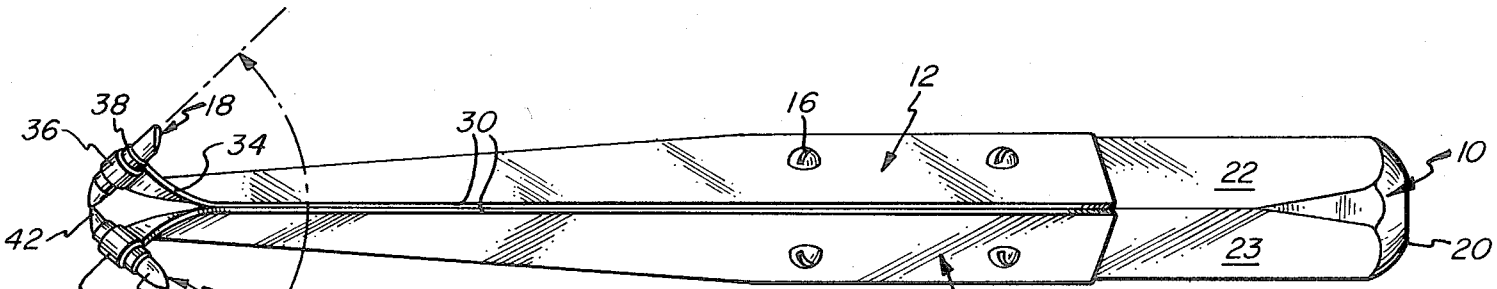
FIG. 2 is a top view of the writing implement thereof.
Figure 5:
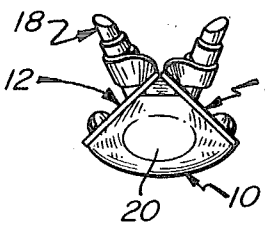
FIG. 5 is an end elevational view of the opposite end.
Figure 4:
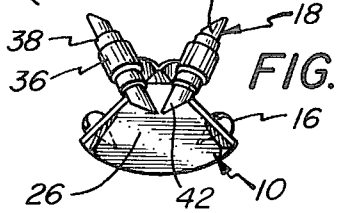
FIG. 4 is an end elevational view of the marking end thereof.

The orientation of the major axes of the marking elements 18 as determined by the major axes of the barrel portions 36 and sleeves 38 may be along the major axes of the blades 12,14, but, as shown in FIGS. 2 and 3, a more effective orientation is preferred. The axes of the marking elements 18 are preferably oriented at a compound angle to the major axis of the writing implement, and this angle is best described by considering the top and side views as seen in FIGS. 2 and 3.

In FIG. 3, the marking element axes are shown to form a projected acute angle of about 35° to 65° relative to the top surface or major axis of the writing implement. This orientation allows the writing implement to be held at angles of 10° to 60° relative to the writing surface while the major axes of the marking elements will remain within about 30° of vertical, as projected in the side view illustrated in FIG. 7. This orientation allows the writing element tips or points to bear more directly and accurately on the writing surface, which is important when writing elements such as ball point pen elements are used because such elements do not transfer their ink effectively when held at low angles to the writing surface.

In FIG. 2, the writing element axes are shown to form approximately a 90° projected angle relative to each other, and to be symmetrically arranged about the central axis of the writing instrument. This angle may be chosen in a range of about 60° to 90° and results in two distinct features or advantages. Firstly, it provides the user with an unobstructed view of the writing tips 42 so that accurate work may be done while still allowing the writing element tips to bear directly on the writing surface as previously described. Secondly, it allows the writing tips 42 to be closely spaced accurately, especially when the writing elements have their marking points located on the central axes of their cylindrical bodies, which is the case of ball point pen elements and other cartridge type writing elements.

A further effect of this compound angle is to have the axis of each writing implement 18 lie at an acute compound angle with respect to the writing surface in the direction of motion of the tips 42 when the tips are moving apart, that is when pressure is being increased on the tips. This acute angle prevents the motion of the tips from causing a halting or chattering action as they move across the writing surface. Such chattering is likely to occur as the force on the tip is increasing as when the tips are being spread and not as pressure is relieved and the tips are being restored to their normal locations, this being the reason for the acute angle being in the direction of motion of spreading.

In use of the illustrated embodiment, the user comfortably grips the handle 10 as illustrated in FIG. 6 and places the points 42 of the marking elements 18 against the surface of the paper or like workpiece (not shown). If only light pressure is applied, the points 42 of the marking elements 18 stay together and produce a single line or two lines which are closely spaced. As more down pressure is applied, the points 42 of the marking elements 18 will move apart as the blades 12,14 flex along their longitudinal axis. The grip shown in FIG. 6 is used for conventional writing upon horizontal work surfaces. An overhand grip may be used in connection with vertical surfaces.

During normal usage, the user will grip the handle 10 in the area of the fasteners 16 so as to permit the blades to flex over substantially their entire unrestrained length. As seen in FIGS. 6 through 8 the flexing or bending of the blades will occur along the longitudinal axis of the blades 12,14 with no substantial twisting moment. As also seen, the tapered surface 26 and the termination of the handle 10 inwardly from the ends of the blades 12,14 allows the writing implement to be held at an angle of about 10° to 60° relative to the writing surface even when applying substantial downward pressure to effect substantial bending of the blades 12,14.

When smaller letters are to be written, the user grips the handle 10 of the writing implement in an area along the blades 12,14 closer to the marking elements 18 as depicted in FIG. 12. The user is thus able to apply pressure to the outer surfaces of the blades 12,14 to hold them against the underlying surfaces 22,23 of the handle 10 the limit the length of the cantilever beam over which the blades 12,14 may flex. This choking action with respect to the potential flexure of the blades 12,14 allows the user to obtain added control over the flexure and permits obtaining narrower spreads with a higher degree of control, while maintaining similar pressures of the marking elements 18 against the paper or like workpiece.

In addition to the pultruded fiber tips and the pencil lead tips which have been specifically illustrated and described, other marking elements may be provided. For example, ball point pen refills may be utilized for ink marking, and crayons and chalk may also be utilized. For blackboard demonstrations, and for outlining signage, cotton tipped swabs or applicators or felt tips may be effectively utilized. For example, in new demonstrations utilizing a blackboard, the blackboard may be initially "washed" with a light chalk coating, and using cotton tipped swabs saturated with water will remove the light chalk coating to leave a black on white tracing of their motion. In signage, the tips may be dipped in dye or other suitable coloring agent to produce the outline which is to be subsequently filled or the pencil tips may be used to write the letter outlines which are then painted, cutout, carved or otherwise finished.

Desirably the blades are slightly prestressed along their longitudinal axis so that the free portions thereof are biased against the underlying surfaces of the handle. This facilitates firmer control and minimizes the likelihood of injury to the writing implements because the blades are normally held tightly together.

As indicated hereinbefore, the abutting blades should normally define an included angle within the range of 45° to 135°, and preferably 75° to 110°. The illustrated embodiment orients the blades at an included angle of 90° which has been highly effective.

Although the blades may be fabricated from synthetic resin or wood, metallic strip has proven highly effective and is simple to clean. Moreover, by proper choice of the temper or flexing of the metallic strip, substantial resistance to permanent deformation may be readily attained.

Illustrative of a specific construction for a writing implement embodying the present invention is the following.

A handle is fabricated from a piece of wood with an overall length of about 8 inches. Two of the surfaces are flat or planar as illustrated in the drawings and intersect at a 90° angle. The remainder of the periphery of the handle is initially defined by a concave contour, and this arcuate contour extends approximately 4.4 inches from the rearward end. The third surface then becomes planar and tapers to a thickness of about 0.1 inch.

The blades are fabricated from a brass stock of 0.025 inches in thickness and have an overall length before forming of 7.25 inches. Each blade is prestressed by developing an arcuate curvature along its length providing a maximum depth at the center of approximately 0.05 inch. The blades are fastened to the handle by a pair of screws spaced apart 1.5 inches with the screw closest to the marking implements being disposed approximately 2.1 inches from the restrained end of the blades, thus leaving an understrained length for the blades of 4.6 inches. As indicated in the drawings, the ends of the blades are rolled to provide a barrel portion in which a sleeve is soldered, and these sleeves are able to receive marking elements as described previously. With a fiber pen tip of the type illustrated in FIGS. 1–6, the effective beam length from the closest screw to the point of the marking element will be approximately 5 inches.

Thus, it can be seen from the foregoing detailed description and the attached drawings, that the present invention provides a novel and highly effective writing implement which can be utilized to demonstrate various script techniques that involve the spreading of a pair of marking elements under pressure applied by the user. The writing implement invention may be readily fabricated and easily assembled from materials providing a high degree of durability and resistance to wear and corrosion by writing fluids which are normally used.

Having thus described the invention, what is claimed is:

1. A writing implement for generating a pair of lines of variable spacing by varying the downward pressure on the marking point of the implement, comprising:

(a) an elongated handle for gripping by the writer's hand;

(b) a pair of elongated, substantially planar blades of flexible material having one end thereof secured to said handle and projecting beyond one end of said handle, said blades having their major axes extending along the length thereof substantially parallel to the longitudinal axis of said handle and having their minor axes extending perpendicularly to said major axes, said blades being of generally planar cross section over substantially the entire projecting portion thereof, said blades being angularly disposed on said handle so that said minor axes thereof intersect to define an included angle of about 45°–135°;

(c) a pair of marking elements removably secured to the other ends of said blades and projecting therefrom, said marking elements having closely spaced marking points at the projecting ends thereof, whereby sufficient downward pressure applied by the writer's hand against the points and thereby the blades against a work surface causes said blades to flex along their major axes and said points of said marking elements to move apart to generate a pair of spaced lines with the spacing varying with the amount of pressure applied.

2. The writing implement in accordance with claim 1 wherein said marking elements are pen points which retain ink along the length thereof for dispensing at the points thereof.

3. The writing implement in accordance with claim 1 wherein said marking elements are pencil leads to generate the lines.

4. The writing implement in accordance with claim 1 wherein said blades are metallic and taper to a reduced width along the minor axes adjacent said other ends thereof.

5. The writing implement in accordance with claim 1 wherein said blades have increasing flexibility towards said other ends thereof.

6. The writing implement in accordance with claim 1 wherein said blades have substantially rectilinear abutting edges along one elongated edge thereof and the opposite edges converge over at least some of the length of said projecting portions.

7. The writing implement in accordance with claim 1 wherein the surface of said handle spaced from the intersection of said minor axes of said blade members tapers to a reduced cross-section at its end adjacent said marking elements.

8. The writing implement in accordance with claim 7 wherein said handle has a cross-section including two converging planar surfaces against which said blades are disposed and a third surface extending therebetween, said third surface tapering over a substantial portion of its length.

9. A writing implement for generating a pair of lines of variable spacing by varying the downward pressure on the marking point of the implement, comprising:

(a) an elongated handle for gripping by the writer's hand;

(b) a pair of elongated, substantially planar blades of flexible material having one end thereof secured to said handle and projecting beyond one end of said handle, said blades having their major axes extending along the length thereof substantially parallel to the longitudinal axis of said handle and having their minor axes extending perpendicularly to said major axes, said blades being angularly disposed on said handle so that said minor axes thereof intersect to define an included angle of about 45°-135°, said blades being of generally planar cross-section over substantially the entire projecting portion thereof and having increasing flexibility towards said other ends thereof;

(c) a pair of marking elements removably secured to the other ends of said blades and projecting therefrom, said marking elements having closely spaced marking points at the projecting ends thereof, whereby sufficient downward pressure applied by the writer's hand against the points and thereby the blades against a work surface causes said blades to flex along their major axes and said points of said marking elements to move apart to generate a pair of spaced lines with the spacing varying with the amount of pressure applied.

10. The writing implement in accordance with claim 9 wherein said blades are metallic and taper to a reduced width along the minor axes adjacent said other ends thereof.

11. The writing implement in accordance with claim 9 wherein said blades have substantially rectilinear abutting edges along one elongated edge thereof and the opposite edges converge over at least some of the length of said projecting portions.

12. The writing implement in accordance with claim 9 wherein the surface of said handle spaced from the intersection of said minor axes of said blade members tapers to a reduced cross-section at its end adjacent said marking elements.

13. In a method of writing, the steps comprising:

(a) providing a writing implement for generating a pair of lines at variable spacing, said implement comprising: an elongated handle for gripping by the writer's hand, a pair of substantially planar, elongated blades of flexible material having one end thereof secured to said handle and projecting beyond one end of said handle, said blades having their major axes extending along the length thereof substantially parallel to the longitudinal axis of said handle and having their minor axes extending perpendicularly to said major axes, said blades being of generally planar cross section over substantially the entire projecting portion thereof, said blades being angularly disposed on said handle so that said minor axes intersect to define an included angle of about 45°-135°, and a pair of marking elements secured to the other ends of said blades and projecting therefrom with closely spaced marking points at the projecting ends thereof;

(b) holding said writing implement at an acute angle to the surface of a workpiece to be inscribed; and (c) moving said writing implement and thereby said marking points along said surface to generate a pair of lines thereon;

(d) applying varying down pressure on said implement and thereby upon said marking points to produce flexing of said blades along their length and variation of the spacing between said marking points, thus producing lines on said surface of varying spacing.

14. The writing method of claim 13 wherein said marking elements are pen points and said method generates a pair of ink lines.

15. The writing method of claim 13 wherein the flexing of said blades is reduced by gripping the implement closer to said other end of said blades to provide greater control in producing well defined characters of smaller size.

* * * * *